US005340098A

United States Patent [19]

Gunderson

[11] Patent Number: 5,340,098

[45] Date of Patent: Aug. 23, 1994

[54] SINGLE SHEET SUPPLIER

[75] Inventor: Ernest M. Gunderson, Minneapolis, Minn.

[73] Assignee: Fargo Electronics, Inc., Eden Prairie, Minn.

[21] Appl. No.: 121,755

[22] Filed: Sep. 14, 1993

[51] Int. Cl.[5] ..... B65H 3/30

[52] U.S. Cl. ..... 271/21; 271/9; 271/121; 271/127; 271/170

[58] Field of Search ..... 271/9, 19, 21, 115, 271/121, 126, 127, 169, 170

[56] References Cited

U.S. PATENT DOCUMENTS

| | | | |
|---|---|---|---|
| 4,363,477 | 12/1982 | Miyashita | 271/9 |
| 4,871,160 | 10/1989 | Yoshino | 271/9 |
| 4,896,871 | 1/1990 | Idenawa | 271/9 |
| 4,991,830 | 2/1991 | Yamanaka | 271/9 |

FOREIGN PATENT DOCUMENTS

| | | | |
|---|---|---|---|
| 2618089 | 4/1976 | Fed. Rep. of Germany | 271/9 |
| 3608273 | 9/1987 | Fed. Rep. of Germany | 271/9 |
| 0145043 | 11/1981 | Japan | 271/9 |
| 0067431 | 4/1982 | Japan | 271/9 |
| 0069642 | 4/1983 | Japan | 271/9 |
| 0006540 | 1/1985 | Japan | 271/9 |
| 0124450 | 6/1986 | Japan | 271/9 |
| 0028127 | 1/1989 | Japan | 271/9 |
| 0028134 | 1/1989 | Japan | 271/9 |

*Primary Examiner*—H. Grant Skaggs
*Assistant Examiner*—Carol L. Druzbick
*Attorney, Agent, or Firm*—Kinney & Lange

[57] ABSTRACT

A single sheet supplier from a plurality of sheets inserted to reach a pair of inclined corner tabs past a resiliently restrained and under a roller. The roller is selectively rotated to force a paper sheet in contact therewith past the pair of inclined corner tabs which partially and temporarily block the progress of the sheet corners thereby causing them initially to buckle and then snap forward to separate the sheet engaged by the rollers from the remainder of the stack.

10 Claims, 5 Drawing Sheets

SINGLE SHEET SUPPLIER

BACKGROUND OF THE INVENTION

The present invention relates to printers and, more particularly, to printers depositing materials for print images on sheets of paper selected from a stack of cut-sheet paper.

The use of personal computers and, correspondingly, desk top printers controlled in part by such computers has increased very rapidly over the last several years. Many different printing technologies have been developed for these printers beyond that used in the impact printers initially performing in this role, including ink jet, thermal wax transfer and thermal dye sublimation printing technologies.

As usage of personal computers has grown, there has been a corresponding increase in the demand for relatively compact printers that are expected to print relatively modest numbers of documents a day. In addition, the printer output often comprises private or business letters, or office memorandums, which are sent to single or relatively few addressees. In these circumstances, there has been an increased demand for printers which print on cut-sheet paper, one sheet at a time, rather than printing on stock from rolls or the like.

One manner in which the need to supply individual sheets to the printing process portions of such single-sheet printers has been met is through the use of cassette trays in which a stack of cut-sheet paper is placed as a store for the printer. Typically, such a cassette tray has a pair of corner tabs over corners of the stacked paper at the leading edge of such a tray as it is intended to be inserted into the printer. These corner tabs are provided parallel with the major surface of the stacked paper. A drive roller, in contact with the top sheet of the stack, selectively forces, as needed, such a top sheet forward to thereby force the leading corners of that sheet against these corner tabs causing the sheet to buckle and then snap forward over the tabs to separate the sheet from those underlying in the stack below.

Such cassette trays operate quite well, but require a significant amount of time to be reloaded with a stack of paper. First, the cassette tray must be removed from the printer. After the stack of cut-sheet paper has been inserted therein, the cassette must be reinserted into the recorder and properly engaged with whatever holding arrangement has been provided. Thus, there is a desire to increase the speed of the paper reloading operation in a printer, as well as to avoid the expense of a separate cassette tray.

SUMMARY OF THE INVENTION

The present invention provides a sheet supplier for printers which print on a single cut-sheet paper at a time. A supply port provides access to a paper passageway that can be opened by inserting paper therein to forcibly separate a resiliently restrained side thereof from an opposite side thereof serving as a guide for that paper to direct it toward a roller. The paper is to be inserted sufficiently to reach that roller. Selectively rotating the roller, as a sheet of paper is needed for printing, forces the paper sheet in contact therewith past the roller to have corners thereof engage corresponding ones of inclined corner tabs which partially and temporarily block the progress of the sheet corners thereby causing them initially to buckle so as to bulge away from the remainder of the stack and then snap forward to separate the sheet engaged by the rollers from the remainder of the stack. The roller then forces that sheet along a desired output path.

DETAILED DESCRIPTION OF THE PREFERRED EMBODIMENTS

Figure 1:
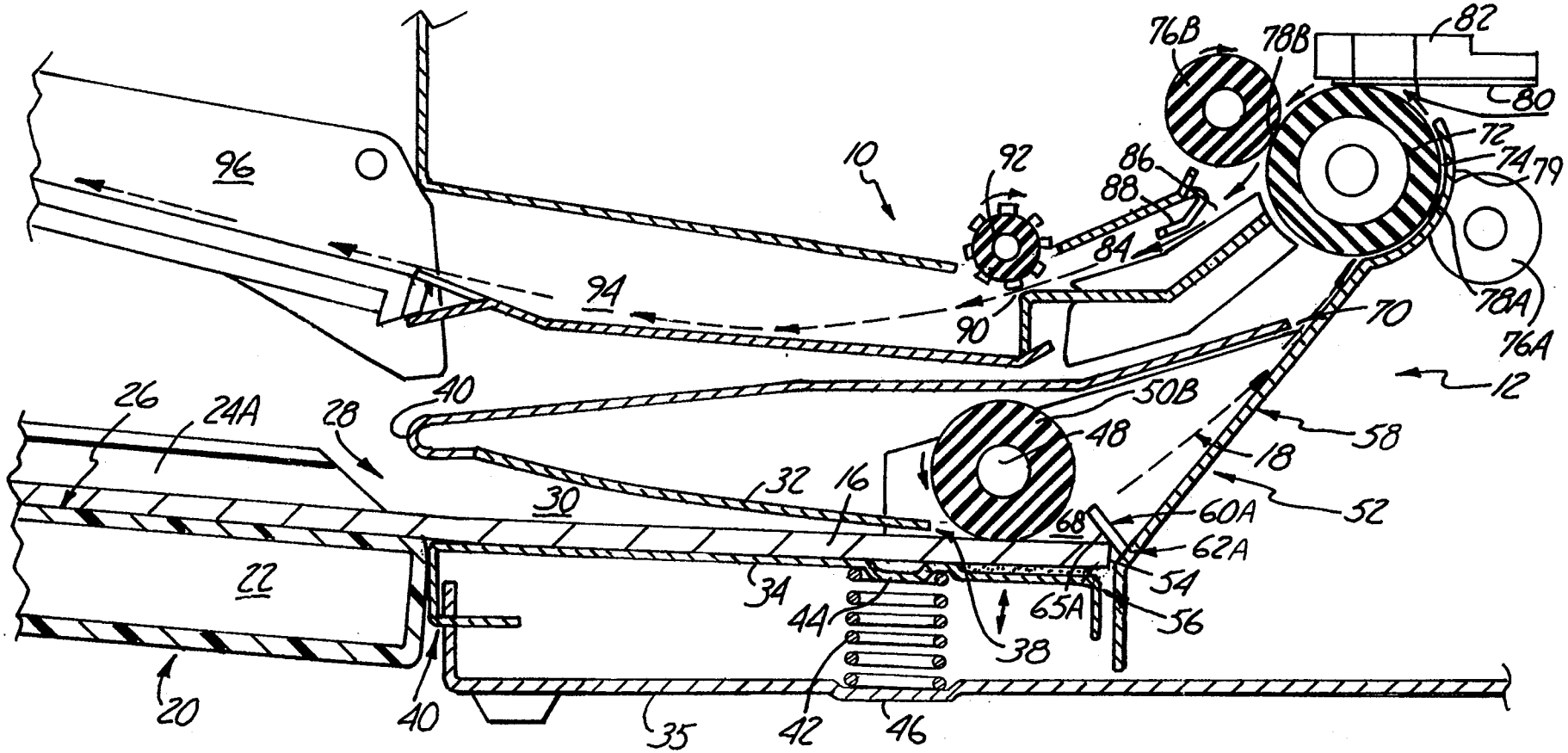
FIG. 1 is a sectional view of a paper handling portion of a printer.
Figure 5:
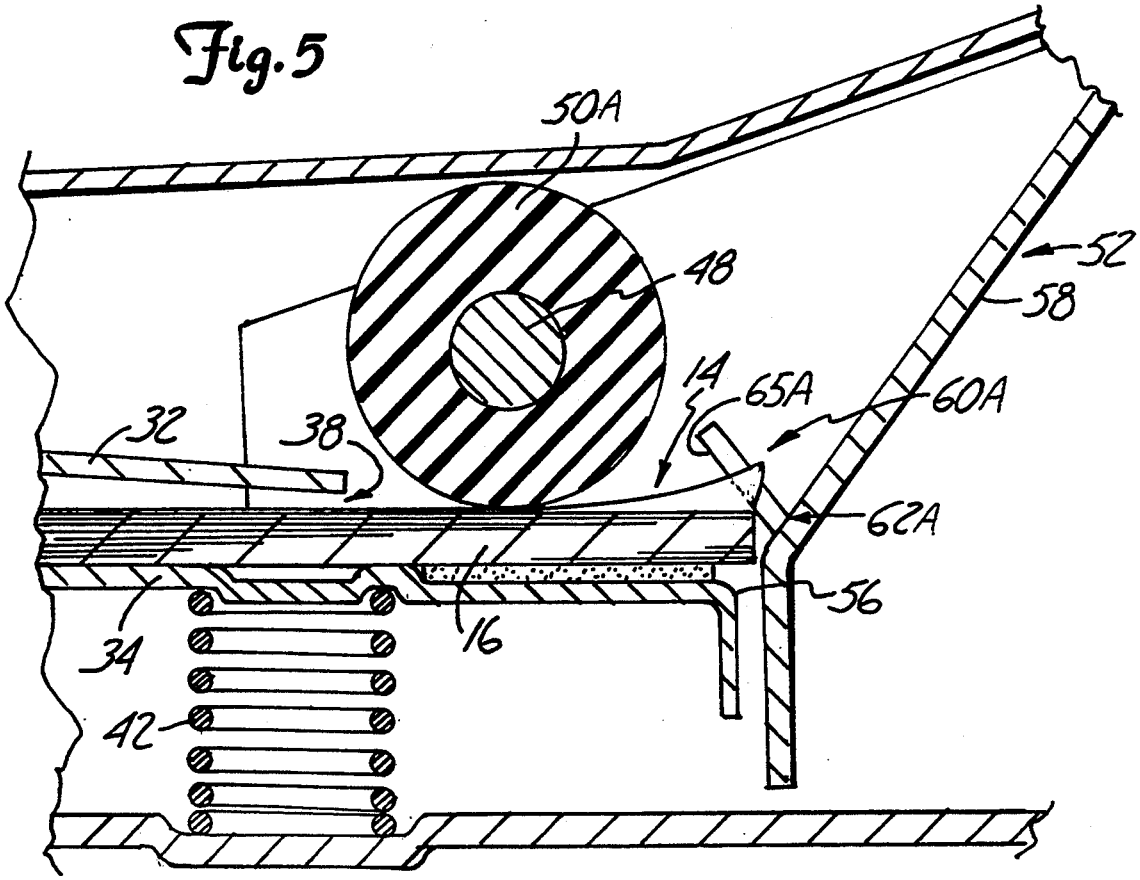
FIG. 5 is an enlarged side view of the printer of FIG. 1.
Figure 6:
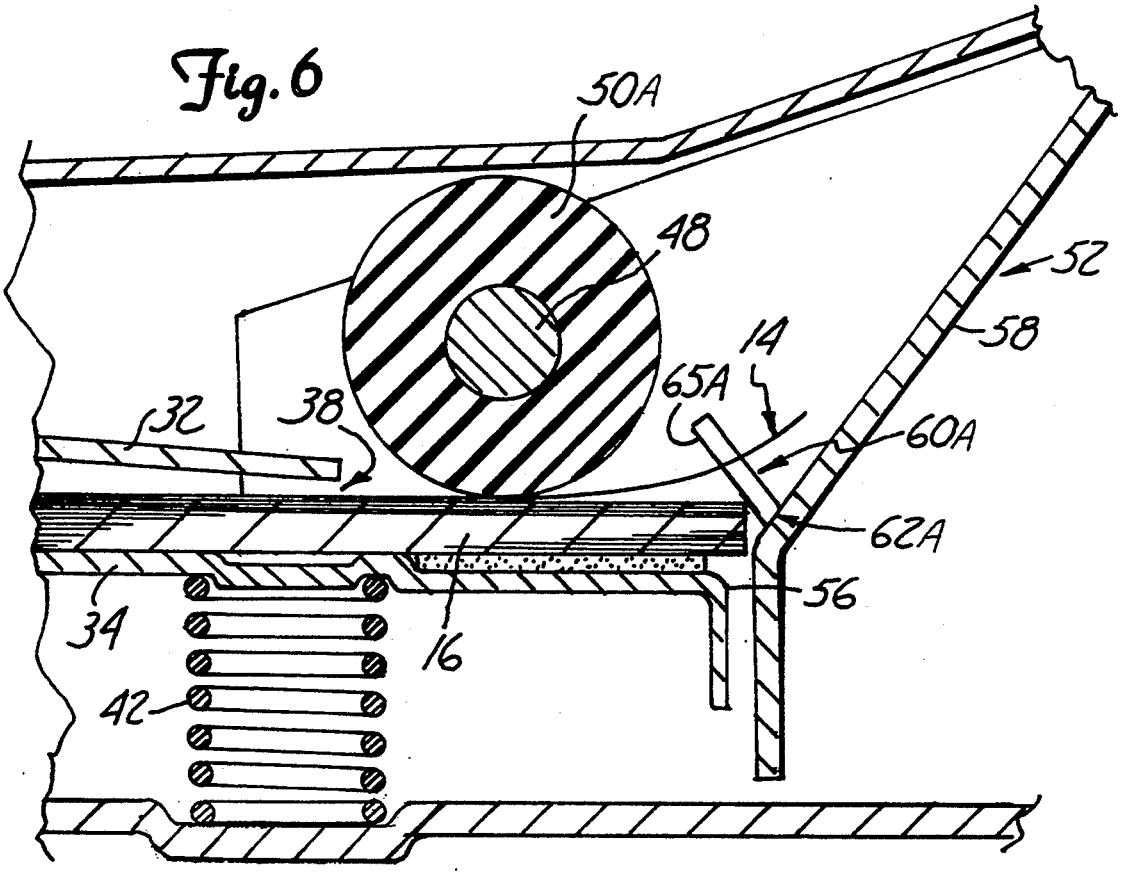
FIG. 6 is an enlarged side view of the primer of FIG. 1.
Figure 7:
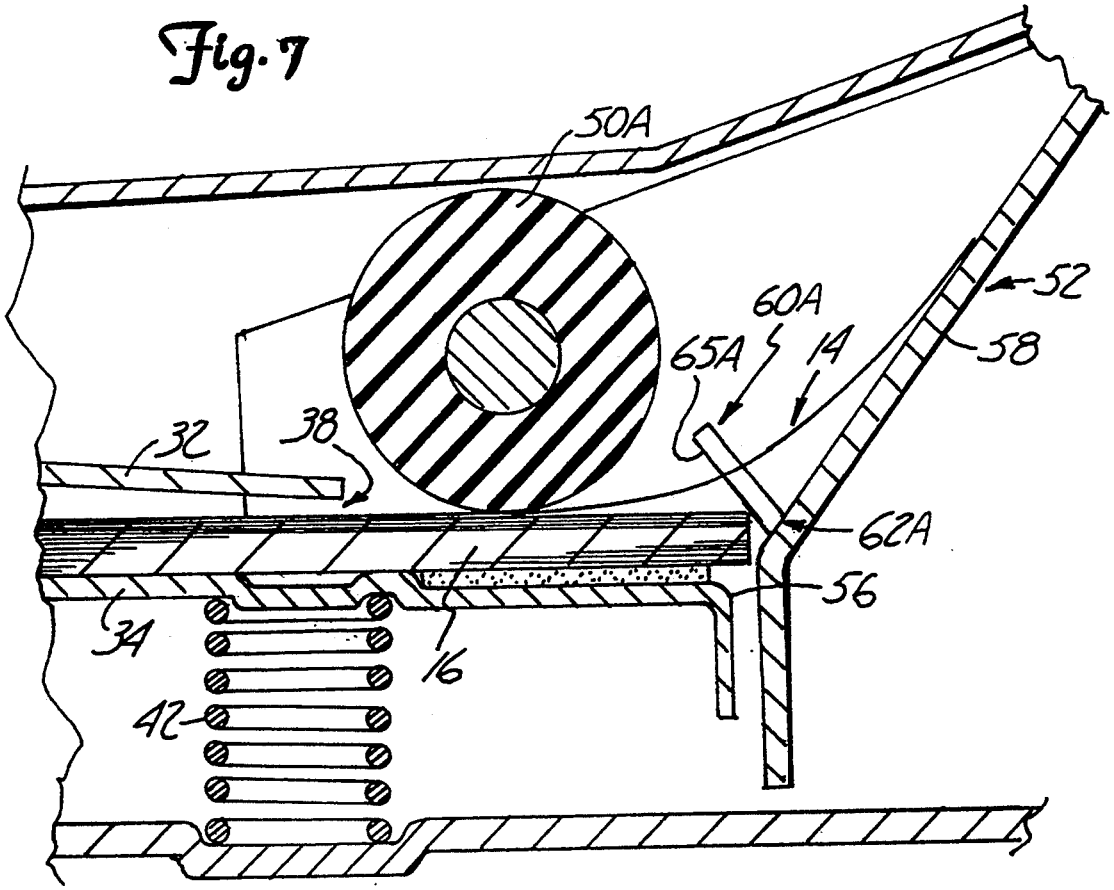
FIG. 7 is an enlarged side view of the printer of FIG. 1.

FIG. 1 shows a side sectional view of a paper handling portion, 10, of a recorder, embodied here as a printer, 12. Paper handling portion 10 moves just the top sheet of paper, 14, as shown in FIGS. 5, 6, and 7, from a stack of cut-sheet paper, 16, along a path, 18, using a plurality of rollers and guides.

As shown in FIG. 1, a paper tray, 20, is rotatably and removably attached to printer 12. Paper tray 20 functions as a cover for covering various input and output apertures in the front of printer 12 when paper tray 20 is in a substantially vertical position, and functions as a paper support for supporting stack of cut sheet paper 16 when paper tray 20 is in a substantially horizontal position.

An extensible support plate (not shown) alternatively extends and retracts from a cavity, 22, within paper tray 20 about an end opposed to the end paper tray 20 is removably and rotatably attached to printer 12 on. The extensible support plate extends such that additional support for stack 16 of cut sheet paper is provided.

A pair of paper guides, more particularly a first paper guide 24A and a second paper guide (not shown), are connected to an inside face, 26, on paper tray 20 such that when paper tray 20 is in a substantially horizontal position, stack of cut sheet paper can be provided between said paper guides and can be inserted into an input or supply port, 28, in printer 12. One of said paper guides is laterally adjustable such that the width between said paper guides can be narrowed or enlarged as desired typically based upon the width of stack 16 of cut sheet paper to be inserted.

Input port 28 is a slot-like aperture longitudinally positioned between sides adjacent thereto (not shown) supported inside primer 12 for receiving stack 16 of cut sheet paper. Input port 28 is the entrance to a variable passageway, 30, where stack 16 of cut sheet paper will be inserted and stored such that one sheet of paper 14 at a time can be removed from the top of stack 16 during the printing process.

Figure 2:
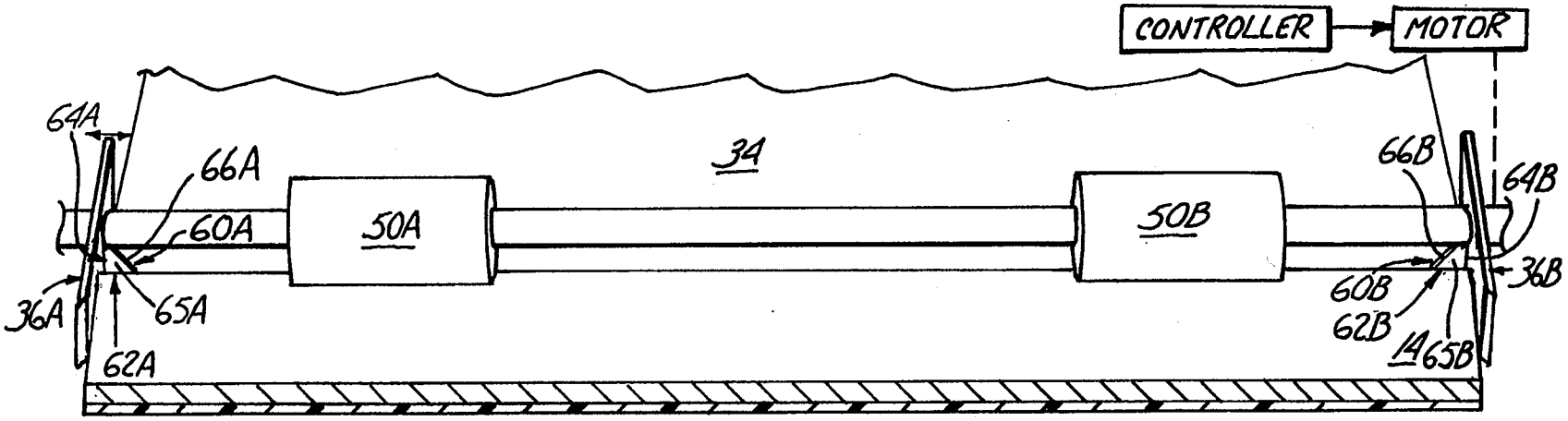
FIG. 2 is a frontal perspective of the printer of FIG. 1.
Figure 3:
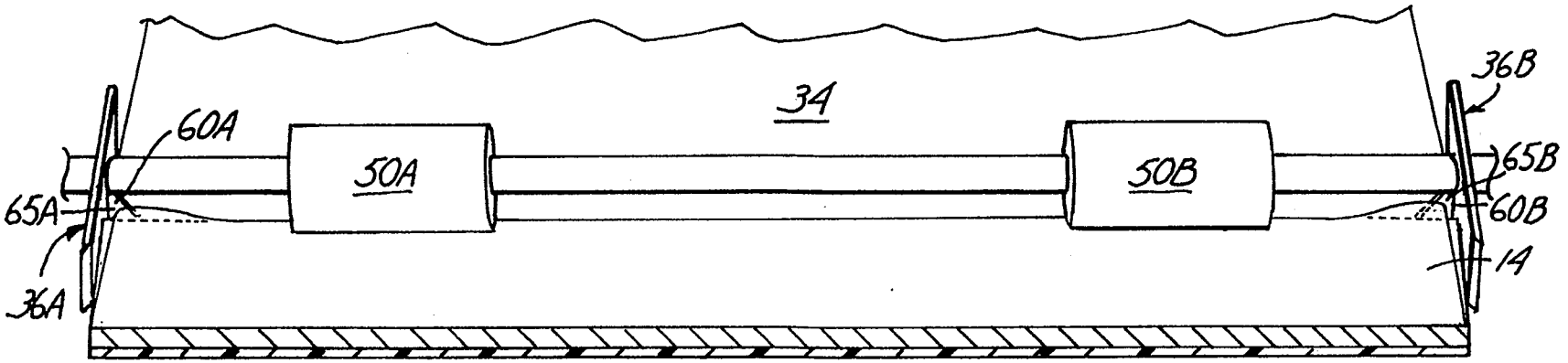
FIG. 3 is a frontal perspective of the printer of FIG. 1.

Variable passageway 30 has an upper limit provided by a fixed guide side, 32, and a lower limit provided by a spring-loaded forcing or otherwise resiliently urged side, 34, such that fixed guide side 32 is across from, or opposed to, spring-loaded forcing side 34. A pair of confinement sides, more particularly a first confinement side, 36A, and a second confinement side, 36B, as shown in FIGS. 2, 3, and. 4, are laterally positioned along opposite edges spring-loaded forcing side 34 to further form passageway 30. Confinement sides 36A and 36B direct stack 16 of cut sheet paper when that stack is inserted into variable passageway 30 through input port 28. This stack exits the passageway through an intermediate port, 38, that is on the opposite end of passageway 30 from input port 28. Confinement side 36A is also laterally adjustable as shown by the double-ended arrow thereby in FIG. 2 so that again the width between these confinement sides can be narrowed or enlarged based on the width of the paper in stack 16.

FIG. 1 shows forcing side 34 positioned such that stack 16 of cut sheet paper, when properly loaded, rests simultaneously on forcing side 34, paper tray 20 and the extensible plate therein when extended. Forcing side 34 is rotatably attached to a base structure, 35, of printer 12 near input port 28 by a formed end portion, 40, of spring-loaded forcing side 34 provided at the end thereof nearest input port 28.

A compression spring, 42, is mounted at a location on spring-loaded forcing side 34 intermediate the ends thereof at ports 28 and 38, by a key, 44, extending outward from this location on spring-loaded forcing side 34 which is adapted to fit into the open interior of compression spring 42. Spring 42 is held in place at its other end by a notch, 46, in printer base structure 35 adapted to have that spring fit therein so that forcing side 34 is urged by the spring away from structure 35.

Fixed guide side 32 is inclined with respect to spring-loaded forcing side 34. This inclined construction results in input port 28 being of a larger area in a vertical plane than is intermediate port 38 if spring 42 is not compressed so that stack 16 of cut sheet paper, inserted into input port 28, is guided towards intermediate port 38 by sides 32 and 34.

Figure 4:
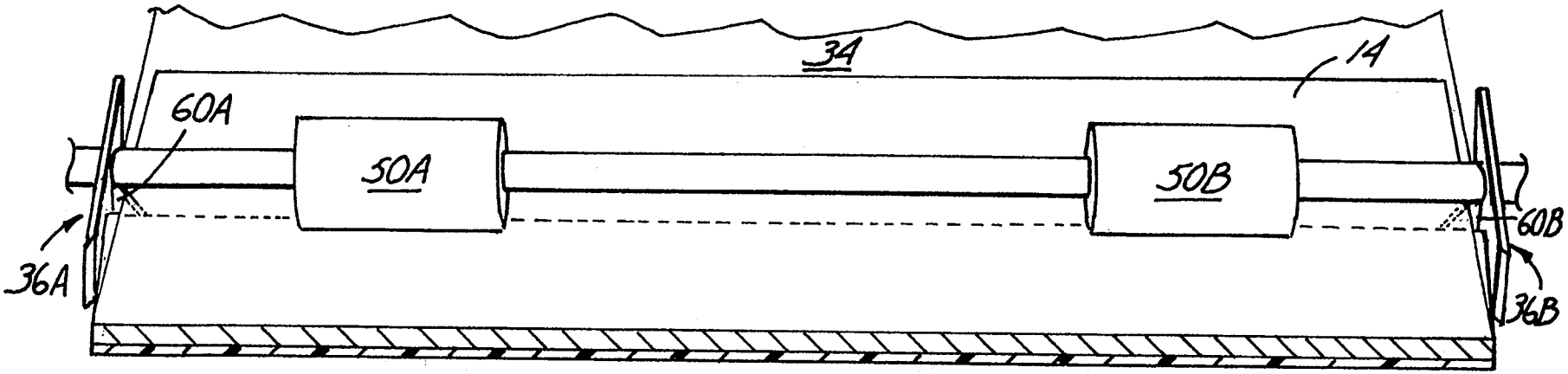
FIG. 4 is a frontal perspective of the printer of FIG. 1.

A paper actuation apparatus comprises a rotatable shaft, 48, that is driven by motor controlled by a controller and a pair of rotatable transfer rollers, more particularly a first rotatable transfer roller, 50A, and a second rotatable transfer roller, 50B, as shown in FIGS. 2, 3, and 4. Rollers 50A and 50B are in rotatable contact with the top sheet of stack 16 of cut sheet paper and, if caused to rotate, will in turn cause at least the upper portion of that stack to be advanced incrementally, preferably just the top sheet of paper the rollers are in such contact with. Rollers 50A and 50B are positioned outside of the fully guided portion of variable passageway 30 at a location just beyond intermediate port 38 such that stack 16 of cut sheet paper is pinned therebetween rollers 50A and 50B and forcing side 34. Forcing side 34 deflects about attached portion 40 through compressing spring 42 so that, in the absence of stack 16, forcing side 34 is urged toward rollers 50A and 50B to be in tangential contact therewith. If, on the other hand, stack 16 is inserted into variable passageway 30, forcing side 34 is forced away from rollers 50A and 50B as that stack approaches those rollers to permit the stack to be positioned between rollers 50A and 50B and forcing side 34 as it is further advanced past port 38.

An inclined guide plate. 52, is attached to primer 12. Stack 16 has a leading edge, 54, such that, when stack 16 is fully inserted into variable passageway 30, the stack extends into and through both input port 28 and intermediate port 38 and under pair of rotatable transfer rollers 50A and 50B so that leading edge 54 reaches an inner edge, 56, of forcing side 34 located past rollers 50A and 50B. Leading edge 54, when positioned at inner edge 56 of forcing side 34, is nearly in contact with an inclined portion, 58, of inclined guide plate 52.

FIGS. 2, 3, and 4 show a pair of inclined corner tabs, more particularly, a first corner tab, 60A, and a second corner tab, 60B, each having corresponding ones of base portions. 62A and 62B, "vertical" sides, 64A and 64B, and inclined sides, 66A and 66B. Base portions 62A and 62B of first corner tab 60A and second corner tab 60B, respectively, are attached to inclined guide plate 52 at the base of inclined portion 58, while vertical side 64A of first corner tab 60A is attached to first confinement side 36A supported on the left side of printer 12, and vertical side 64B supported on the right side of second corner tab 60B is attached to second confinement side 36B of printer 12. First corner tab 60A and second corner tab 60B have front inclined surfaces, 65A and 65B, facing stack 16 that are oriented to lie in a plane that transversely intersects inclined guide plate 52. Each of inclined sides 66A and 66B extends from the corresponding one of vertical sides 64A and 64B to the corresponding one of base portions 62A and 62B.

FIG. 2 shows top cut-sheet 14 from stack 16 of cut-sheet paper in a first position where stack 16 of cut-sheet paper, and its top sheet 14, are inserted through variable passageway 30 to be against each of inclined corner tabs 60A and 60B. The relatively large areas covered by inclined surfaces 65A and 65B of inclined corner tabs 60A and 60B easily intercept and temporarily block all sheets of stack 16 from further advancing to reach inclined portion 58 of inclined guide plate 52 and force the corner edges of this stack to be oriented downward. However, inclined corner tabs 60A and 60B are positioned such that, if rollers 50A and 50B are selectively rotated, the frictional force between these rollers and top sheet 14, which is in contact therewith, will force this sheet further toward inclined portion 58 of plate 52. There will be an insufficient frictional force between top sheet 14 and the next sheet down in stack 16 to move that next sheet much, if any, distance forward also.

Advancing top sheet 14, in being partially and temporarily blocked by pair of inclined corner tabs 60A and 60B with its corner edges caught under the incline of inclined surfaces 65A and 65B so that such edges are further oriented more vertically downward, begins to buckle in regions, 68, behind these edges under the force imparted to this sheet by rollers 50A and 50B so that these regions behind those edges begin to bulge upward. Each of these buckling regions 68 are located between rollers 50A and 50B and the corresponding one of inclined corner tabs 60A and 60B. FIG. 3 shows top sheet 14 advanced to a second position where portions of that sheet are buckling against inclined corner tabs 60A and 60B such that each frontal corner on advancing sheet 14 is lifted up from the remaining sheets of stack 16 there below. FIG. 5 shows an enlarged view from the side looking parallel to rotatable shaft 48 with advancing top sheet 14 having reached this second position.

Continued rotation of rollers 50A and 50B causes the corners of advancing top sheet 14 to further buckle to bulge enough in regions 68, in being locked against the incline of inclined surface 65A and 65B temporarily blocking it, that frontal edge 54 finally snaps over and past inclined sides 66A and 66B of these tabs into a third position as shown in FIG. 4. An enlarged side view of this third position is shown in FIG. 6.

Rotatable transfer rollers 50A and 50B continue to rotate so that advancing top sheet 14 continues sliding up inclined guide plate 52 as shown in FIG. 7 where advancing sheet 14 will, if said rollers continue to rotate, be forced along plate 52 through an output port, 70. This is seen in FIG. 1.

Once top sheet 14 from stack 16 has been advanced through output port 70, that sheet comes into contact with a rotating main paper roller, 72, at an input passage, 74. As top sheet 14 is further advanced by rollers 50A and 50B into input passage 74, that sheet comes into contact with a first guide roller, 76A extending through an opening in plate 52. First guide roller 76A rotates in a direction opposite to main paper roller 72, and squeezes sheet 14 against main paper roller 72, as this sheet is advanced through passage 74 to a first contact area, 78A where such squeezing takes place. A guidance cover, 79, forces the leading edge of advancing top sheet 14 to follow the outer circumference of main paper roller 72.

The leading edge of advancing top sheet 14 is then further required by a color material supply ribbon, 80, to continue to follow the outer circumference of main paper roller 72. On those portions of advancing top sheet 14 that are to be printed upon, a thermal printhead, 82, assembly with a thermal printhead therein will be actuated such that the thermal printhead comes into contact with supply ribbon 80 and heats the coloring material therein. Actuation of the thermal printhead "sandwiches" advancing top sheet 14 between main paper roller 72 and supply ribbon 80 where deposition of coloring materials occurs.

A second guidance roller, 76B, rotating in the same direction as first guidance roller 76A, and in the direction opposite to that of main paper roller 72, squeezes sheet 14 against roller 72, as it reaches a second contact area, 78B, to guide this sheet through an exit shoot, 84. Exit shoot 84 comprises of an initial exit channel, 86, with a guide flange, 88, followed by a guidance port, 90, with a ribbed roller, 92, for further guiding the paper. After advancing top sheet 14 passes through guidance port 90, the sheet is deposited in a receiving bin, 94. A supplemental receiver, 96, may be attached to receiving bin 94 at the end thereto opposite that at guidance port 90.

Although the present invention has been described with reference to preferred embodiments, workers skilled in the art will recognize that changes may be made in form and detail without departing from the spirit and scope of the invention.

What is claimed is:

1. A paper sheet supplier for selecting single sheets of paper from a corresponding stack of cut-sheet paper provided therein and transferring each such sheet after selection thereof along an output path, said paper sheet supplier comprising:

a variable passageway means having an input port through which a stack of cut-sheet paper can be inserted and further having a guide side extending between a pair of confinement sides that is positioned across from a forcing side to surround at least in part a substantially closeable paper passageway such that said forcing side resiliently opposes increased separation from said guide side caused by insertion through said input port of a stack of cut-sheet paper therebetween;

a rotatable transfer roller means separated from said input port by at least a portion of said guide side and extending past said guide side to be across at least a portion of said paper passageway adjacent said guide side when said paper passageway is opened as a result of said forcing side being separated from said guide side;

a pair of corner structures each at least partially located on a side of said transfer roller means opposite that side on which said input port is located and each extending past said guide side to be across at least a portion of said paper passageway adjacent both said guide side and a corresponding one of said confinement sides when said paper passageway is opened as a result of said forcing side being separated from said guide side, said pair of corner structures each having a surface portion facing said transfer roller means which is inclined with respect to said guide side; and an output guide means capable of directing a sheet of paper forced to pass said pair of corner structures by said rotatable transfer roller means along said output path.

2. The apparatus of claim 1 wherein said forcing plate pivots about an axis adjacent said input port.

3. The apparatus of claim 2 wherein said forcing side is forced by a spring means in contact therewith, but spaced apart from said axis, to rotate about said axis toward said guide side.

4. The apparatus of claim 3 further comprising a door and tray means which can rotate in one direction to cover said input port, and can rotate in an opposite direction to provide an input tray to support a stack of cut-sheet paper inserted through said input port into said variable passageway means.

5. The apparatus of claim 4 wherein said door and tray means has a height limiting means limiting the height of a stack of cut-sheet paper which can be inserted into said input port.

6. The apparatus of claim 1 wherein said rotatable transfer roller means is formed by a shaft having a pair of roller structures mounted thereon which can rotate therewith and which are separated from one another.

7. The apparatus of claim 6 wherein said shaft is connected to a motor means capable of rotating said shaft.

8. The apparatus of claim 7 wherein a control means selectively directs said motor means to rotate said shaft.

9. The apparatus of claim 1 wherein said surface portions of said pair of corner structures each extend past said guide side both toward and away from said forcing side.

10. The apparatus of claim 9 wherein said surface portions of said pair of corner structures each have an edge that is inclined with respect to said guide side, the edges being across portions of said paper passageway from each other and adjacent thereto.

* * * * *

UNITED STATES PATENT AND TRADEMARK OFFICE

CERTIFICATE OF CORRECTION

PATENT NO. : 5,340,098

DATED : August 23, 1994

INVENTOR(S) : ERNEST M. GUNDERSON

It is certified that error appears in the above-indentified patent and that said Letters Patent is hereby corrected as shown below:

Col. 2, line 16, delete "primer", insert --printer--

Col. 2, line 57, delete "primer", insert --printer--

Col. 4, line 7, delete "portions.", insert --portions,--

Signed and Sealed this

Sixth Day of December, 1994

*Attest:*

Bruce Lehman

BRUCE LEHMAN

*Attesting Officer*

*Commissioner of Patents and Trademarks*